United States Patent [19]

Hartley

[11] 3,959,662

[45] May 25, 1976

[54] ENGINE STARTING SYSTEMS

[75] Inventor: Roger Henry Hartley, Sutton Coldfield, England

[73] Assignee: The Lucas Electrical Company Limited, Birmingham, England

[22] Filed: June 5, 1974

[21] Appl. No.: 476,554

[30] Foreign Application Priority Data

July 25, 1973 United Kingdom ..... 35433/73

[52] U.S. Cl. ..... 290/38 R; 123/179 B; 123/179 BG

[51] Int. Cl.[2] ..... F02N 11/00

[58] Field of Search..... 123/179 B, 179 BG, 179 K, 123/179 M, 179 H, 179 F; 290/38 R, 38 A, DIG. 11; 307/141.4; 318/484, 471; 74/6, 7

[56] References Cited

UNITED STATES PATENTS

| | | | |
|---|---|---|---|
| 1,474,371 | 11/1923 | Kirk | 123/179 B |
| 3,193,648 | 7/1965 | DeFalco | 337/127 |
| 3,609,383 | 9/1971 | Welsh | 290/38 R |
| 3,631,370 | 12/1971 | Hollis | 337/135 |
| 3,670,283 | 6/1972 | Holden | 337/354 |
| 3,744,467 | 7/1973 | Wagner | 123/179 B |
| 3,788,151 | 1/1974 | Campan | 74/7 A |
| R24,023 | 6/1955 | Schmidinger | 337/135 |

FOREIGN PATENTS OR APPLICATIONS

| | | | |
|---|---|---|---|
| 1,007,744 | 5/1952 | France | 123/179 B |

*Primary Examiner*—Charles J. Myhre
*Assistant Examiner*—James D. Liles
*Attorney, Agent, or Firm*—Holman & Stern

[57] ABSTRACT

An engine starting system particularly but not exclusively for use in a road vehicle, the system including a manually operable switch controlling energisation of a solenoid winding. The solenoid winding when energised causes movement of a pinion of a starter motor to an operative position. There is provided a thermally operable snap-action switch, the heater of which is energised by way of said manually operable switch. The snap-action switch controls energisation of a relay, and the relay in turn controls energisation of the starter motor. The operating time of the thermally operable switch provides a delay between movement of the pinion to its operative position, and energisation of the starter motor, after operation of the manually operable switch.

3 Claims, 3 Drawing Figures

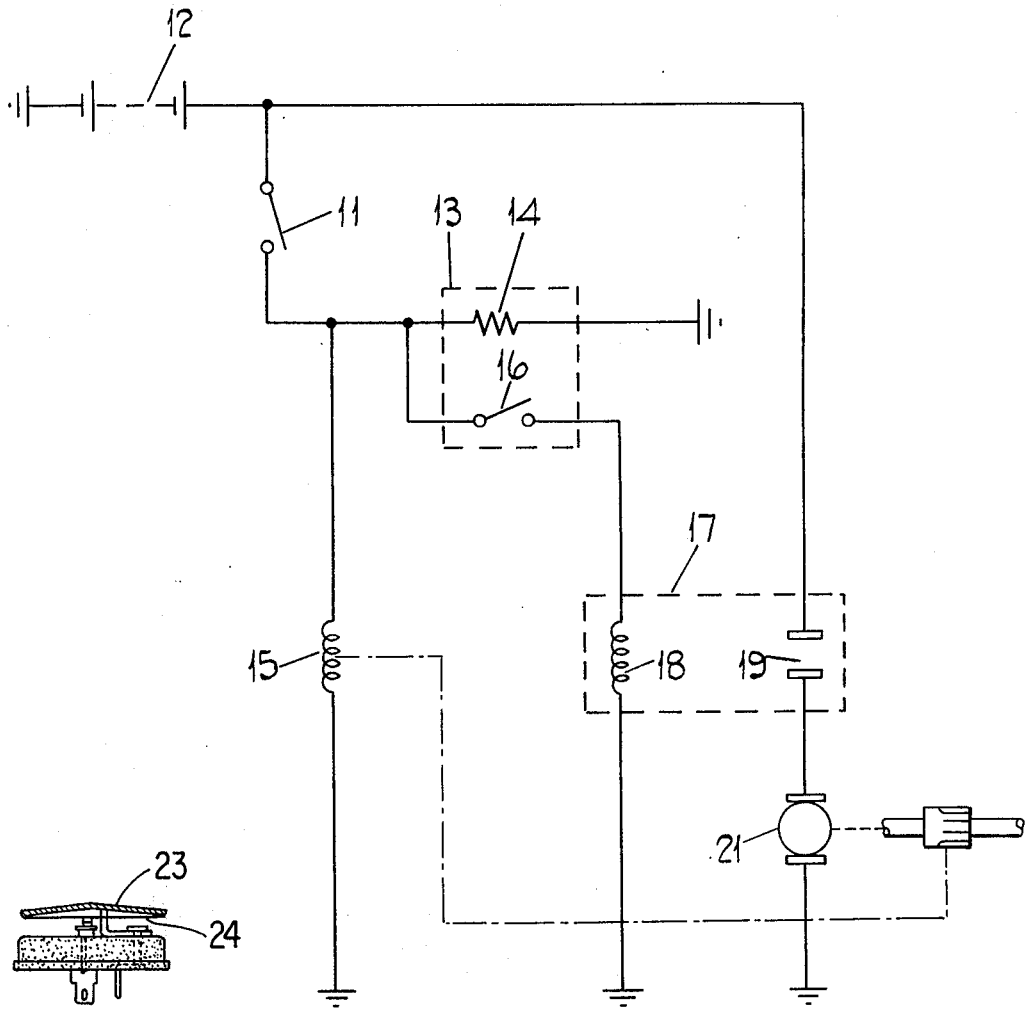
FIG. 1
FIG. 2
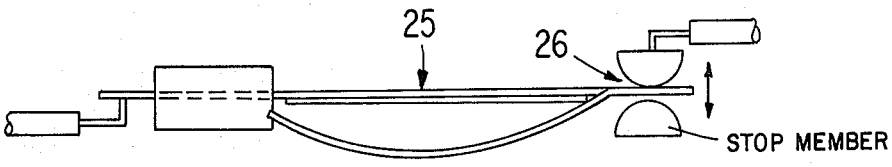
FIG. 3

ENGINE STARTING SYSTEMS

This invention relates to engine starting systems particularly but not exclusively for road vehicles.

A system according to the invention includes a manually operable switch, an electromagnet winding energised by operation of said switch to move a pinion of a starter motor to an operative position, a thermally operable snap-action switch the heater of which also is energised by operation of the manually operable switch, and, a relay energised by way of the thermaly operable switch and controlling energisation of the starter motor, the operating time of the thermally operable switch providing a delay between movement of the pinion to its operative position and energisation of the starter motor.

One example of the present invention is illustrated in the accompanying drawings, wherein FIG. 1 is a circuit diagram of an engine starting system FIG. 2 is a partly diagramatic representation of a snap action switch for use in the circuit of FIG. 1, and FIG. 3 is a partly diagramatic representation of an alternative form of snap-action switch for use in the circuit of FIG. 1.

Referring to the drawing, the engine starting system which is particularly but not exclusively intended for a road vehicle, includes a manually operable control switch 11 one pole of which is connected to one terminal of the battery 12, the other terminal of the battery 12 being earthed. The other pole of the switch 11 is connected through the heater 14 of a thermally operable snap-action switch 13 to earth.

A point intermediate the switch 11 and the heater 14 is electrically connected through an electromagnet winding 15 to earth, and is also connected through the contacts 16 of the switch 13 and the winding 18 of a relay 17 to earth. Said one terminal of the battery 12 is further connected to one of the normally open contacts 19 of the relay 17, the other contact of the relay 19 being connected to earth through the starter motor 21.

In the rest condition of the system the switch 11 is open, and so the electromagnet winding 15 is de-energised, the switch 13 is in its rest condition with the contact 16 open, and the relay 17 is in its normally open rest condition. The starter motor 21 is therefore de-energised, and the pinion of the starter motor is in its rest position. Upon closure of the switch 11 the winding 15 is immediately energised and the pinion of the starter motor is moved by the electromagnet to its operative position. The heater 14 of the switch 13 is energised, and after a delay determined by the heating time of the heater 14 the contacts 16 close energising the winding 18 of the relay 17 and closing the contacts 19 so as to connect the starter motor 21 directly across the terminals of the battery 12. Thus after a delay determined by the thermally operable switch 13 the starter motor 21 is energised and cranks the associated engine.

The delay which is provided by the switch 13 between movement of the pinion and energisation of the starter motor ensures that there is sufficient time for the pinion to achieve its operative position prior to the application of cranking torque.

The thermally operable snap-action switch 13 can take a number of forms, but it is important that the thermally operable switch has a snap action since the contacts of the switch must make and break rapidly if arcing at the contacts, and consequential burning of the contacts is to be avoided. A suitable thermally operable snap-action switch as shown in FIG. 2 includes a resilient vane 23 which has secured thereto a thermally extensible strip 24. The strip when cold holds the vane in a first configuration, and upon expansion of the strip the vane snaps to a second configuration. A fixed contact is positioned adjacent the vane and a moving contact is carried either by the vane or by the strip. The strip is heated either by the passage of an electric current through the strip, or by the passage of an electric current through a heater winding wound around the strip. Upon cooling, the strip contracts and returns the vane to its original configuration, the contacts being operated by the movement of the vane and the strip as the vane snaps between its two position.

A further suitable form of switch is shown in FIG. 3 and includes a bi-metallic element 25 which is so arranged as to snap between a position wherein contacts are closed and a position wherein contacts are open as a result of heating of the bi-metallic strip.

I claim:

1. An engine starting system including an electrically operated starter motor having a driven pinion which is movable axially of an output shaft of the starter motor between an operative position and a rest position, a manually operable switch, an electromagnet winding energisation of which is controlled by operation of said manually operable switch, said electromagnet winding when energised causing movement of said pinion from its rest position towards its operative position, a thermally operable snap-action switch including a heater energisation of which is controlled by said manually operable switch, and, a relay energised by way of said thermally operable switch, said relay controlling energisation of the starter motor, and the operating time of the thermally operable switch providing a delay between movement of the pinion of the starter motor to its operative position, and energisation of the starter motor.

2. A system as claimed in claim 1 wherein said thermally operable snap-action switch is of the kind including a resilient vane having secured thereto a thermally extensible strip, said strip when cold constraining the vane to a first configuration and when heated allowing the vane to snap to a second configuration.

3. A system as claimed in claim 1 wherein said thermally operable snap-action switch is of the kind including bi-metallic snap action element.

* * * * *